US007582029B2

(12) United States Patent
Nikiema et al.

(10) Patent No.: US 7,582,029 B2
(45) Date of Patent: Sep. 1, 2009

(54) METHOD FOR PLAYING A GAME OF BALL

(76) Inventors: Roger Nikiema, 01 BP 1984, Ouagadougou (BF) 01; Hilaire Nikiema, 01 BP 1984, Ouagadougou (BF) 01; Wend Kouni Nikiema, 01 BP 1984, Ouagadougou (BF) 01

( * ) Notice: Subject to any disclaimer, the term of this patent is extended or adjusted under 35 U.S.C. 154(b) by 161 days.

(21) Appl. No.: 11/742,646

(22) Filed: May 1, 2007

(65) Prior Publication Data

US 2008/0274840 A1 Nov. 6, 2008

(51) Int. Cl.
*A63B 67/00* (2006.01)
*A63B 63/00* (2006.01)

(52) U.S. Cl. ..... 473/415; 473/465; 273/402; 273/398

(58) Field of Classification Search ..... 473/415, 473/465; 273/349, 398, 402, 407, 408, 412
See application file for complete search history.

(56) References Cited

U.S. PATENT DOCUMENTS 443,073 A * 12/1890 Darrach ..... 273/398
1,584,547 A * 5/1926 Jones ..... 473/476
1,989,484 A * 1/1935 Maryfield et al. ..... 273/402
2,008,359 A * 7/1935 Lamb ..... 273/402
2,372,111 A * 3/1945 Norberg ..... 273/407
3,895,801 A * 7/1975 Baird ..... 273/350
4,168,066 A * 9/1979 Sole et al. ..... 273/402
5,072,947 A * 12/1991 Blue ..... 273/371
5,390,913 A * 2/1995 Kepler ..... 473/472
5,615,890 A * 4/1997 Blue ..... 473/469
2006/0189416 A1 * 8/2006 Nelson ..... 473/415

* cited by examiner

*Primary Examiner*—Mitra Aryanpour
(74) *Attorney, Agent, or Firm*—Lucas & Mercanti LLP

(57) ABSTRACT

A ball game platform and a method to play a ball game on said platform are disclosed. The ball game platform comprising a rectangular surface divided into two sections with boundary lines and a middle line, and a duel pole set on one end of the middle line. The method of playing a ball game for two teams of players to play on one section of the platform comprising providing a soft ball being bounceable; setting a set of rules for the game, judging the score according to the rule, breaking tie score by using duel pole and declaring a winner. The rules for the game do not allow the player to touch the ball by hands except in the services and duels. The rules may include the rules of starting the gaming, serving the ball, shooting, and exchanging of field, as well as rules of violations.

12 Claims, 2 Drawing Sheets

METHOD FOR PLAYING A GAME OF BALL

THE FIELD OF THE INVENTION

The present invention relates to a ball game platform and a method of playing a ball game. More particularly, a ball game platform with a duel pole and a method of playing a ball game on a said platform by using player's body parts except their hands are disclosed.

BACKGROUND OF THE INVENTION

1. Description of Related Art

Football, also known as soccer is a team sport played between two teams, of 11 players each, and is widely considered to be the most popular sport in the world. It is a ball game played on a rectangular grass field with a goal at each end. The object of the game is to score by maneuvering the ball into the opposing goal. The predominant feature of the sport is that no players other than the goalkeepers may use their hands or arms to propel the ball and goalkeepers can only use their hands on the ball in their goalkeeping area. The winner is the team who score the most goals by the end of the match.

Tennis is a game played between either two players ("Singles") or two teams of two players ("Doubles"). Players use a stringed racquet to strike a hollow rubber ball covered with felt over a net into the opponent's court. In some places tennis is played on a grass court and called lawn tennis to distinguish it from court tennis.

Volleyball is a sport in which two teams separated by a high net use their hands, arms, or (rarely) other parts of their bodies to hit a ball back and forth over the net. Each team is allowed three hits to get the ball over the net to the other team. A point is scored if the ball hits the ground in the opponents' court, if the opponents commit a fault, or if they fail to return the ball properly.

It is desirable for a ball game field having simpler settings within modest cost and a method of playing the game with unique rules to improve body coordination and to promote the nimbleness of the parts of human body other than the hand.

SUMMARY OF THE INVENTION

This invention relates to a ball game played on a field, comprising a hard plane rectangular field or platform with a boarder line and a middle line dividing the field into two sections and a duel pole standing at one end of the middle line having three vertical panels, each with a hole in the middle. The game uses a soft ball being bounceable, and observes a set of rules for two teams of players each playing on one of the two sections of the field. The rules include 1) the ball can not be touched by hands except in services; 2) scoring one point when a player delivers the ball to the other section and the player of the other team fails to take control of the ball after one bounce; 3) breaking a tie score by shooting the ball through one of the holes of the duel pole.

The ball game provides a horizontal field or platform having boundary lines and a middle line. The field is of a dimension of 7.10 m (279.53 inches) long by 4.10 m (161.42 inches) wide including the boundary lines. The boundary lines and the middle line are all of 5 cm (1.97 inches) wide.

The duel pole of the game is of 1.2 m (47.24 inches) high, the panels are evenly spaced from the top to the grounding end of the pole and the holes are of 10 cm (3.94 inches) diameter.

The ball of the game may have a diameter of about 5 cm (1.97 inches) and a weight of about 55 grams (1.94 oz), it may be a rubber pressurized ball having a core pressurized with air or nitrogen, similar to a tennis ball without the felt.

The rules of the ball game may further comprise timing rules, extension of time rules, serving rules, foul rules, and score rules.

The invention also includes a method of playing the ball game, comprising the steps of starting the game by throwing the ball onto the middle line of the field, judging the score according said rules, optionally, breaking a tie score by shooting the ball through one of the holes of the duel pole; and declaring the winner based on the scores of each team.

DETAILED DESCRIPTION OF THE INVENTION

Figure 1:
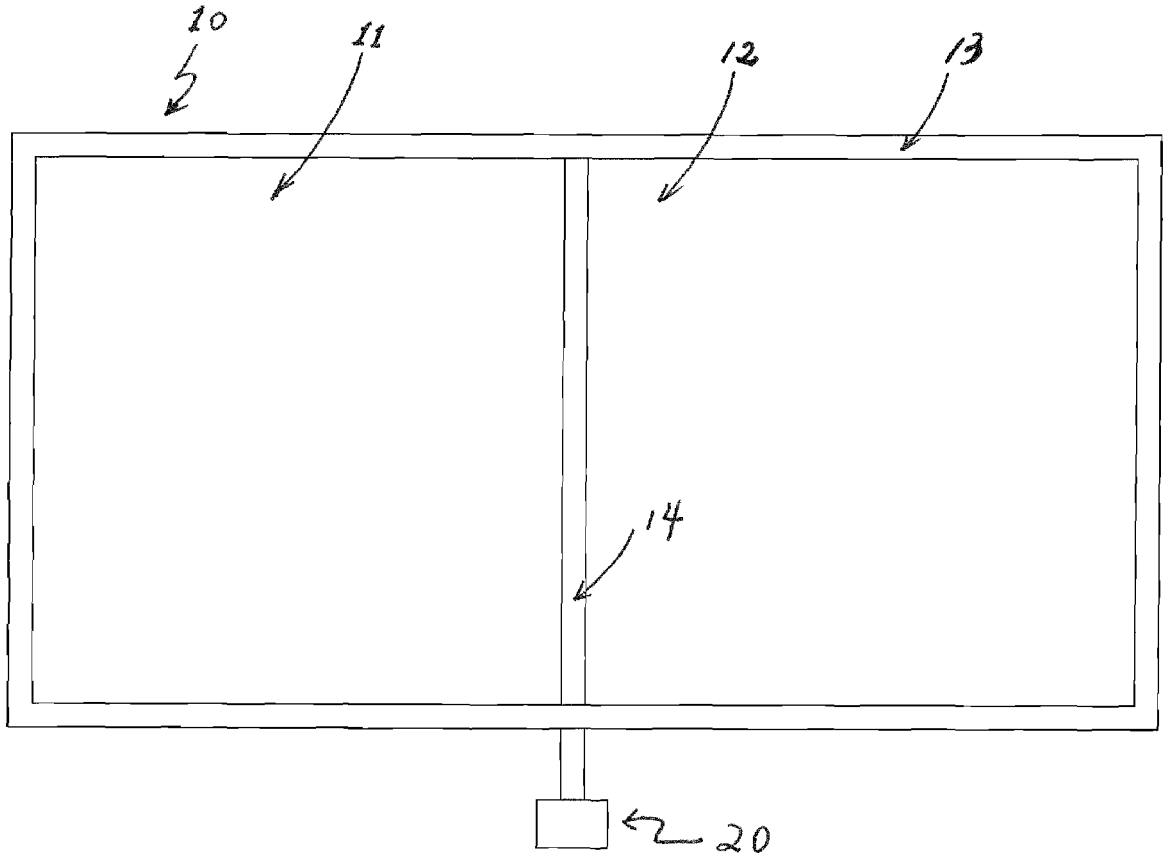
FIG. 1 is a plan view of the game field/platform with the Duel Pole of the present invention.

Referring more particularly to the drawings, the numeral 10 generally designates the game field or platform of the present invention which may be of any suitable material; for example, the platform can be made by wood panels, concrete, or compact soil. It should be a hard, plane, rectangular horizontal surface having enough resilience to bounce the ball when playing the game.

A preferred embodiment of the field/platform 10 is of 7.10 m (279.53 inches) long by 4.10 m (161.42 inches) wide. The playing area is delineated by boundary line 13 with the width of 5 cm, and divided into two sections 11 and 12 by a middle line 14 with the width of 5 cm. The boundary line and middle line can be made by different materials from the field. They may also simply be painted lines with any desired color.

Figure 2A:
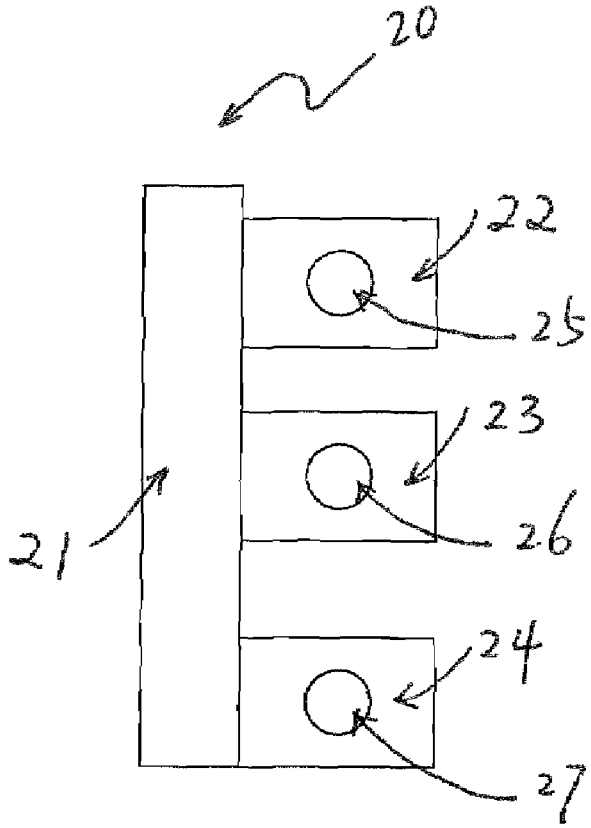
FIG. 2A is a side plan view of the Duel Pole of the present invention.
Figure 2B:
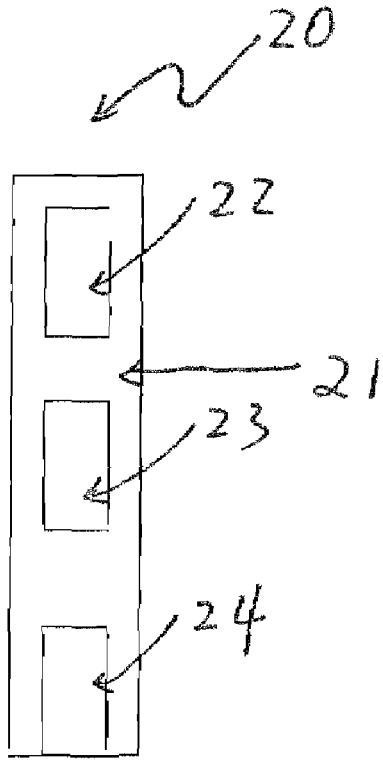
FIG. 2B is a front plan view the Duel Pole.

According to one of the embodiment, a duel pole 20 is attached to one of the ends of the middle line. As shown in FIGS. 2A and 2B, the duel pole comprises a supporting pole 21, attached with 3 vertical panels 22, 23, and 24, which are evenly spaced along the length of the pole. Each of the vertical panels has a hole, indicated as 25, 26 or 27, in the middle of the panels. In particular, the pole is in a rectangular shape of 10 cm×7.5 cm×120 cm (3.94×2.95×47.24 inches), the vertical panels are of 20 cm×20 cm×5 cm (7.88×7.88×1.97 inches), and the holes have a diameter of 10 cm (3.94 inches).

The balls used can be subdivided into two categories:

1) Pressurized balls have a core pressurized with air or nitrogen. These balls may lose their pressure, and hence playing properties, over time.

2) Non-pressurized balls are made from a thicker rubber core, and the pressure within the core is equal to the ambient pressure. These balls tend to hold their playing characteristics for a longer period of time, as it is only the cloth that deteriorates.

The ball of the game may have a diameter of about 5 cm (1.97 inches) and a weight of about 55 grams (1.94 oz). The ball must be capable of bouncing.

The game will be played by two teams with one to three players in each team. There will be only one player at one side to compete with another player at the other side at a given time. For games with the team having 3-players, there will be two (2) waiters. One of them may enter once the player of his side leaves the field.

In FIGS. 2A and 2B, it is shown, in plan view, of the duel pole of a preferred embodiment, where the supporting pole has a rectangular cross section and it is made of wood. The vertical panels are of rectangular wood blocks. The purpose of the duel pole is to break the tied score, which will be disclosed hereinafter.

The game can be played by two teams competing with each other. The number of the player on each team should be the same. Before starting the game, both teams must agree on which section they want to use.

The game is played under a set of rules that will be described hereinafter, and is started with a bouncing ball on the middle line. The player receiving the ball will keep the ball bouncing with his body parts except his hand(s) and delivering the ball to the other section until one of the following occur:

A. a score point is made

B. a foul is called.

C. a timeout occurs.

The rules are disclosed in detail as follows:

Starting:

To start the game, an umpire bounces the ball on the middle line of the field. While the ball is still bouncing, the players of the two teams compete to get the ball to his/her control. The players are not permitted to step into their opponent's section of the field, however, their body parts can reach over the middle line to get the ball in the air of the other section.

The above rule of starting of the game is also used when the game extends to the second section.

At all times, the ball should be bouncing instead of rolling or stopping on the ground. The players can not touch the ball with their hands except in only two situations, where the player serves the ball and makes a duel shot.

Controlling the Ball

Without using hands, the ball may be kept by a player at his/her side by patting the ball with the sole of his foot against the surface of his section of the field in order to keep the ball bouncing.

Returning the Ball

After starting, the player with controlling of the ball should return the ball to the other section of the field. The two players then volley, back and forth until there is a score, a change of service or time expires. The players volley by hitting the ball using any body part, except hands of the player. The return ball can be to any place on the other player's section of the field, including the boundary lines. A player can not go to the other side to hit or claim the ball.

Serving the Ball

Serving the ball is made by hand and head of the server. To serve, the serving player throws the ball by hand and hits the ball using his/her head. The ball should bounce from the head and volley into the adversary's section of the field.

Boundary Violation

After the ball's first bounce on the player's section, if the player failed to gain the control of the ball before the ball goes out-of-bounds and lands, it is considered a boundary violation.

Technical Fouls

1. Hand-Touch Violations

It is a technical foul when a player touches the ball with his hand(s) except in the service of the ball. He shall lose his service by this violation.

2. Loss of Bounce Violations

It is also a technical foul if a player lets his ball stop bouncing after he takes control of the ball.

The technical foul will cost the service of the player committing the foul. The player with the technical foul must turn the ball over to the player at the other side for serving.

3. Control Violations

It is a technical violation if a player fails to get control of the ball after its first bounce.

Foul Shots

When the player returns or serves the ball, if the ball goes out-of-bounds without a first landing either in the other section of the field or on the boundary lines of it, it is considered a foul shot. A player with foul shot loses his service to the other player.

Control-Time Violation

A player can control the ball by patting the ball with the sole of his foot against the field. However, if the ball is kept by the player for more than 1 (one) minute without returning to the other side of the field, it is considered a time violation.

Changes of Service

The player loses the service and turns the ball over to the other team for serving when:

A. a control-time violation is called.

B. a loss of bouncing violation is called.

C. a boundary violation is called.

D. a hand-touch violation is called.

E. a control violation is called.

Resume

After change of service, the game is resumed by serving from the team gaining the right of service.

Timing of the Game

There are several ways to time the game, one must be agreed on before starting the game.

Usually, there are two (2) sessions for one game play, with thirty (30) minutes for each session. Players are required to change sections after the first session, which is called the half time. In a 3-player team game, a team's player can be replaced once by another player in his team.

Two extensions with 3 minutes each may follow if there is a tie. For the extension in a 3-player team game, each player plays one (1) minute and turns the ball to the next player of the team.

Scoring

By the end of the two sessions, the player or the team which scores the most wins the game.

1) One-Point Scoring

One-point scoring applies to the shot by head (head-shot), where the ball is sent out to the adversary's field by bouncing from his head. If the ball lands on the other section of the field and bounces out-of-bounds and the player of the other side fails to return the ball onto the field, or the player fails to gain his control of the ball after the first bounce on his section of the field, one point will be awarded to the head shooter.

2) Two-Point Scoring

For a head-shot, if the ball is sent to the other section of the field and lands directly onto any of the boundary lines (5 cm (1.97 inches) lines) of the other section, two points will be awarded to the shooter. Two points will be awarded even if the other player returns the ball back to the field after the ball's bouncing on the boundary lines.

3) Three-Point Scoring

Three-point scoring is for the shots by foot (foot-shot), where the player sends the ball to the other section of the field by upper portion of his foot. If a player shoots the ball by his foot and the ball lands on the other section of the field and bounces out-of-bounds and the player of the other side fails to return the ball onto the field, or the player fails to gain control of the ball after the first bounce on his section of the field, one point will be awarded to the foot shooter.

4) Four-Point Scoring

For a foot-shot, if the ball is sent to the other section of the field and lands on the boundary line (5 cm (1.97 inches) lines) of the section, four points will be awarded to the shooter.

Breaking the Tie by Using the Duel Pole

The duel pole is used to determine which team wins if the score is tied by the end of the second sessions. A player from each team will be elected for the duel. The ball is placed at one corner of the boundary lines at the side of duel pole. The duel is conducted according to the following scoring scheme:

1) Foot shot: One point is scored if the player shoots the ball through the hole of the lower panel using his foot.

2) Hand shot: one point is scored if the player takes the ball by hand and throws it through the hole of the middle panel using his hand.

3) Head shot: one point is scored if the player shoots the ball through the hole of the upper panel by bouncing the ball from his head.

There are two sessions for the duel with 3 minutes for each session and in a multiplayer game, the player may take turn for the shooting. The duel may be repeated until a team wins.

Obviously, many modifications and variations of the present invention are possible in light of the above teachings. It is therefore to be understood that within the scope of the appended claims, the invention may be practiced other than as specifically described.

What is claimed is:

1. A ball game platform, comprising:

a hard plane rectangular surface having a border line and a middle line, said hard surface is divided by said middle line into two sections; and a duel pole having a top end and a grounding end, the duel pole positioned vertically outside of the border line at one end of the middle line, said duel pole comprising three vertically arranged rectangular panels including a lower panel, a middle panel and an upper panel, each panel having a hole centrally positioned in the panel, each hole having a horizontal center axis that is perpendicular to the middle line.

2. The ball game platform of claim 1, wherein the duel pole is of 1.2 m (47.24 inches) high, the panels are evenly spaced from the top end to the grounding end of the duel pole and the holes are of 10 cm (4.94 inches) in diameter.

3. The ball game platform of claim 1, wherein the platform is of a size of 7.10 m (279.53 inches) long by 4.10 m (161.42 inches) wide, the boarder line and the middle line are all of 5 cm (1.97 inches) wide.

4. A method for playing a ball game on the platform of claim 1, comprising:

providing a soft ball being bounceable;

starting the game by throwing the ball at the middle line of the platform;

playing the game according to a set of rules comprising:

1) no touching of the ball by hands is allowed except in services or duel shots;

2) scoring one point when a player delivers the ball to an other section and the player on the other section fails to take control of the ball after its first bounce; and 3) breaking a tie score by shooting the ball through one of the holes of the duel pole declaring the winner based on the scores of each team.

5. The method for playing a ball game of claim 4, wherein the ball having a diameter of about 5 cm (1.97 inches) and a weight of about 55 grams (1.94 oz).

6. The method for playing a ball game of claim 5, wherein the ball is a rubber pressurized ball having a core pressurized with air or nitrogen.

7. The method for playing a ball game of claim 4, wherein the rules further comprising a rule of timing comprising:

timing the game with two sessions, each having 30 minutes.

8. The method for playing a ball game of claim 7, wherein the rule of timing further comprising a rule of extension of time.

9. The method for playing a ball game of claim 4, where the rules further comprising a rule of serving comprising:

serving the ball to the adversary's section of the platform by bouncing the ball against the player's head.

10. The method for playing a ball game of claim 4, where the rules further comprising rules of violations, selecting from a group consisting of boundary violations, technical fouls, foul shots, and control-time violations.

11. The method for playing a ball game of claim 4, where the rules further comprising rules of scoring, comprising:

one-point for head-shots, where the ball lands on the other section of the field and the player on the other section fails to gain controls of the ball after a first bounce thereon;

two-point for head-shots, where the ball is sent to the other section of the platform and lands onto the boundary line thereof;

three-point for foot-shots, where the ball lands on the other section of the field and the player on the other section fails to gain controls of the ball after a first bounce thereon; and four-point for foot-shots, if the ball is sent to the other section of the platform and lands onto the boundary line thereof.

12. The method for playing a ball game of claim 4, where the rules further comprising duel rules by using the duel pole comprising:

one point for shooting the ball through the hole of the lower panel using his foot;

one point for throwing the ball through the hole of the middle panel using his hand; and one point for sending the ball through the hole of the upper panel by bouncing the ball from his head.

* * * * *